US008075369B2

(12) United States Patent
Hendrickson

(10) Patent No.: US 8,075,369 B2
(45) Date of Patent: Dec. 13, 2011

(54) CONVERTIBLE NURSING BRA

(75) Inventor: Lisa A. Hendrickson, Mount Laurel, NJ (US)

(73) Assignee: Destination Maternity Corporation, Philadelphia, PA (US)

( * ) Notice: Subject to any disclaimer, the term of this patent is extended or adjusted under 35 U.S.C. 154(b) by 74 days.

(21) Appl. No.: 12/574,371

(22) Filed: Oct. 6, 2009

(65) Prior Publication Data

US 2011/0081826 A1 Apr. 7, 2011

(51) Int. Cl.
*A41C 3/00* (2006.01)

(52) U.S. Cl. ..... 450/86; 450/88

(58) Field of Classification Search ..... 450/36, 450/37, 54–58, 86, 88
See application file for complete search history.

(56) References Cited

U.S. PATENT DOCUMENTS

| | | | | | |
|---|---|---|---|---|---|
| 2,315,614 | A | * | 4/1943 | Glasser | 450/36 |
| 2,613,355 | A | * | 10/1952 | Coleman | 450/36 |
| 2,666,919 | A | * | 1/1954 | Banister | 450/36 |
| 2,782,418 | A | | 2/1957 | Garson | |
| 3,513,852 | A | * | 5/1970 | Seidl | 450/36 |
| 4,648,404 | A | | 3/1987 | Clark | |
| 4,878,879 | A | * | 11/1989 | Kunstadter | 450/36 |
| 5,024,628 | A | | 6/1991 | Sanchez | |
| D351,492 | S | | 10/1994 | Nieslanik | |
| 5,624,296 | A | * | 4/1997 | Weber-Unger | 450/36 |
| 6,155,906 | A | | 12/2000 | May | |
| 6,321,422 | B1 | | 11/2001 | Fildan et al. | |
| 6,346,027 | B1 | * | 2/2002 | Merkovsky | 450/37 |
| 6,517,409 | B2 | * | 2/2003 | Flaherty | 450/1 |
| D523,212 | S | | 6/2006 | Iourina | |
| 7,232,359 | B1 | | 6/2007 | Richardson | |
| D556,978 | S | | 12/2007 | Thunstedt | |
| 7,507,141 | B2 | | 3/2009 | Ward et al. | |
| 2002/0022434 | A1 | | 2/2002 | Plourde | |
| 2005/0112996 | A1 | | 5/2005 | Buehler | |

FOREIGN PATENT DOCUMENTS

| | | |
|---|---|---|
| DE | 202 10 029 U1 | 10/2002 |
| JP | 2002-115104 | 4/2002 |
| JP | 2009-068141 | 4/2009 |

* cited by examiner

*Primary Examiner* — Gloria Hale
(74) *Attorney, Agent, or Firm* — DLA Piper LLP (US)

(57) ABSTRACT

A fold-down convertible nursing bra with front and back reconfigurable straps is described. The cups of the bra are secured with a clip at the top of the shoulder strap that can be unclipped with one hand and folded down to nurse, then clipped back into the original position. A strip of fabric inside the cup remains attached to both the cup and the shoulder strap while the cup is folded down so that the bra remains secure and the clip can be easily accessed in order to reattach the cup. The bra also has back reconfigurable shoulder straps attached with a clip that can be removed and reattached in different positions such that the bra may be worn, for example, in a halter or racerback configuration.

12 Claims, 6 Drawing Sheets

CONVERTIBLE NURSING BRA

BACKGROUND OF THE INVENTION

1. Field of the Invention

The present invention relates generally to the clothing arts, and more specifically to a maternity or nursing bra having interchangeable straps that allow the bra to be worn in a variety of configurations.

2. Description of Related Art

In general, a bra is an article of clothing that covers, supports and raises the breasts. Traditional bras have two cups to hold the breasts, shoulder straps connected to each of the cups, and a band encircling the torso under the breasts. They are often made of fabric, such as cotton or polyester, and may or may not have underwire support in the cups. Traditional bras provide numerous advantages, for example, to support the breasts, to improve the perceived shape or size of the breasts, to minimize movement of the breasts, to preserve modesty by covering the breasts, and to enhance cleavage.

Traditional bras, however, fail to meet the specific needs of nursing mothers, whose milk-filled breasts may be heavier and difficult to manipulate for breastfeeding. Thus, nursing bras were created that provide additional support for heavier breasts and permit comfortable breastfeeding without removal of the bra. Breastfeeding may be accomplished by opening specialized bra cups that expose the nipple, while still supporting the breast. Some specialized cups include flaps of fabric over the cup that can be unclipped and pulled down to expose the breast. Other cups are made of stretchable fabric that can be pulled to the side for access to the breast.

Despite these advances, many nursing bras still do not offer the full flexibility, style, and comfort of traditional, non-nursing, bras, due to the advanced needs of nursing mothers. Nursing mothers are often limited to a small selection of traditional nursing bra styles that require, for example, full-coverage post-partum clothing to cover the bra. Thus, nursing mothers are unable to express themselves by wearing stylish clothing of the woman's choice, such as racerback or halter top styles with conventional nursing bras.

SUMMARY OF THE INVENTION

Thus, there is a need in the art for a convertible nursing bra that allows a mother to alter the configuration of the shoulder straps to accommodate many different styles of clothing, without showing the straps of the bra. Therefore, several objects and advantages of the present invention are: (a) to provide alternate placement of the shoulder straps to accommodate different shirt styles, (b) to provide for one-handed fastening and unfastening of the bra cups for easy and discreet nursing, (c) to provide variable adjustment of the shoulder straps and back band to accommodate the natural changes in a post-partum mother's body.

Still other aspects, features and advantages of the present invention are readily apparent from the following detailed description, simply by illustrating a number of exemplary embodiments and implementations, including the best mode contemplated for carrying out the present invention. The present invention also is capable of other and different embodiments, and its several details can be modified in various respects, all without departing from the spirit and scope of the present invention. Accordingly, the drawings and descriptions are to be regarded as illustrative in nature, and not as restrictive.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

Figure 1:
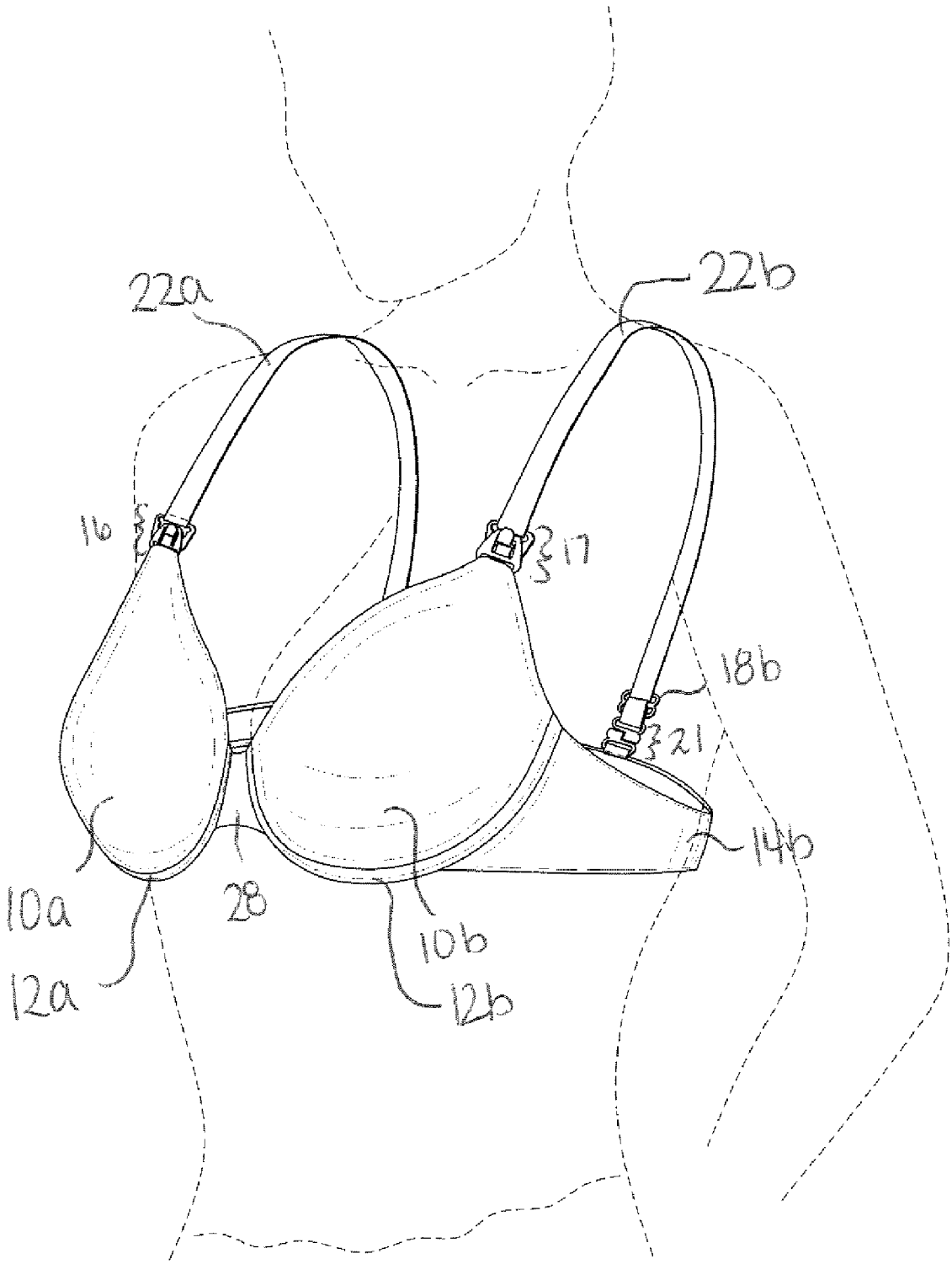
FIG. 1 is a front perspective view of a first embodiment of a nursing bra.

A nursing bra is described. In the following description, for purposes of explanation, numerous specific details are set forth in order to provide a thorough understanding of the exemplary embodiments. It is apparent to one skilled in the art, however, that the present invention can be practiced without these specific details or with an equivalent arrangement.

Referring now to the drawings, wherein like reference numerals designate identical or corresponding parts throughout the several views, FIGS. 1-4 illustrate various views of the convertible nursing bra in a traditional configuration, according to one embodiment of the present invention. The nursing bra has cups 10*a* and 10*b* connected to each other via front band 28 and configured to hold and support the breasts. Cups 10*a* and 10*b* may be any conventional size (A, B, C, D, DD, etc.), or may be variably sized, in order to accommodate the varying breast sizes of nursing mothers. In one embodiment, cups 10*a* and 10*b* have underwire 12*a* and 12*b* located within the lower portion of the cups. In another embodiment, cups 10*a* and 10*b* are wire-free (not shown). Cups 10*a* and 10*b* may also be configured to accommodate a nursing pad. For example, cups 10*a* and 10*b* may each have a nursing pad pocket (not shown). The nursing pad pockets are interior to cups 10*a* and 10*b*, and are configured to hold a nursing pad in front of the nipple in any fashion.

The nursing bra has dual shoulder straps 22*a* and 22*b*. Shoulder straps 22*a* and 22*b* may be of any width, but are preferably of a sufficient width to distribute the weight of the mother's breasts across the shoulders without cutting into the skin. Shoulder straps 22*a* and 22*b* may be made of one or more of any suitable materials, including, for example, knit fabric, cotton, silk, polyester, foam, elastic, microfiber, satin, Lycra™, nylon, spandex, lace, rubber, or plastic. Shoulder straps 22*a* and 22*b* may be any color or pattern to accommodate personal preferences, style, and other factors.

Dual shoulder straps 22*a* and 22*b* are detachably connected to cups 10*a* and 10*b* via fasteners 16 and 17. Fasteners 16 and 17 may be of any type, including clasp elements, clamp elements, or any other suitable strap fastener. Preferably, fasteners 16 and 17 are of a type that can be unhooked with one hand or otherwise with minimal effort so as to facilitate the easy release of the cup for breastfeeding.

Figure 3:
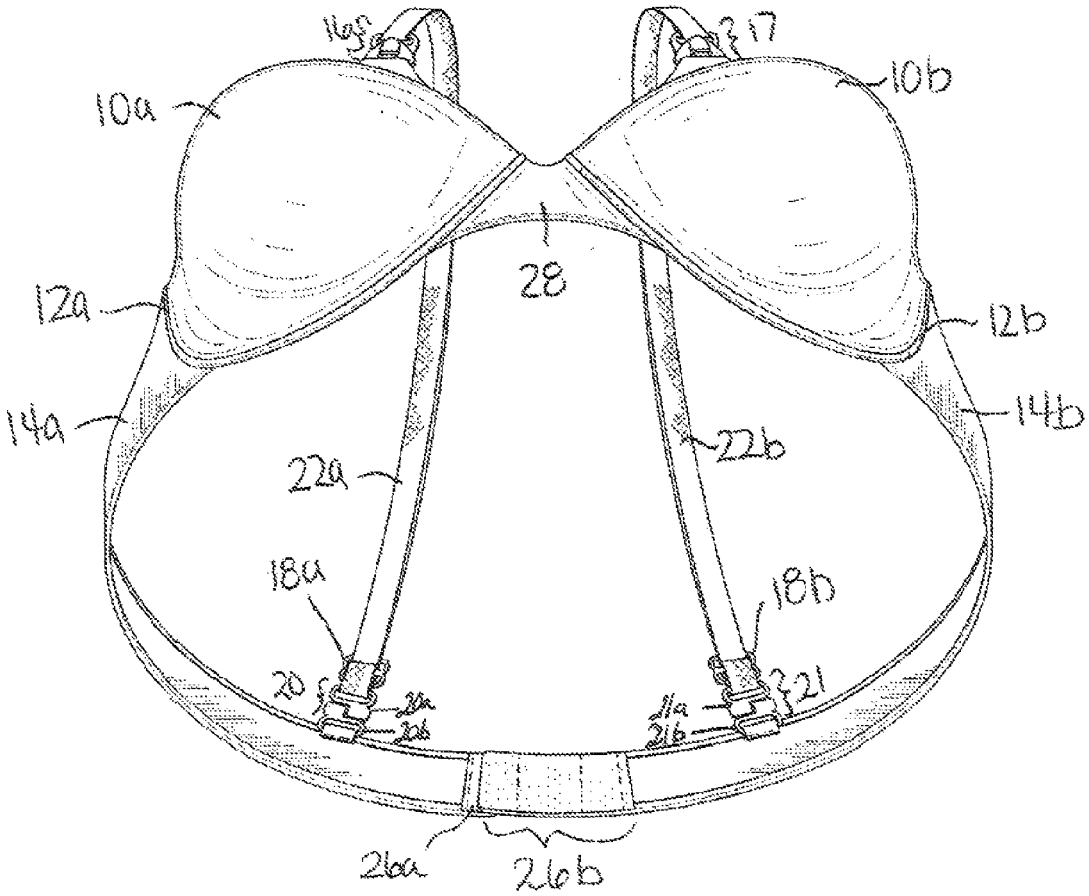
FIG. 3 is a bottom plan view of the first embodiment shown in FIG. 1.

In this configuration, as shown in FIG. 3, shoulder straps 22*a* and 22*b* are detachably connected on the opposite end to back bands 14*a* and 14*b*, respectively, via back fasteners 20 and 21. Back fasteners 20 and 21 may be of any type, including clasp elements, clamp elements, or any other suitable strap fastener. Preferably, back fasteners 20 and 21 are of a type that is flat and lays against the skin, so as to prevent back fasteners 20 and 21 from being visible under clothing.

Figure 4:
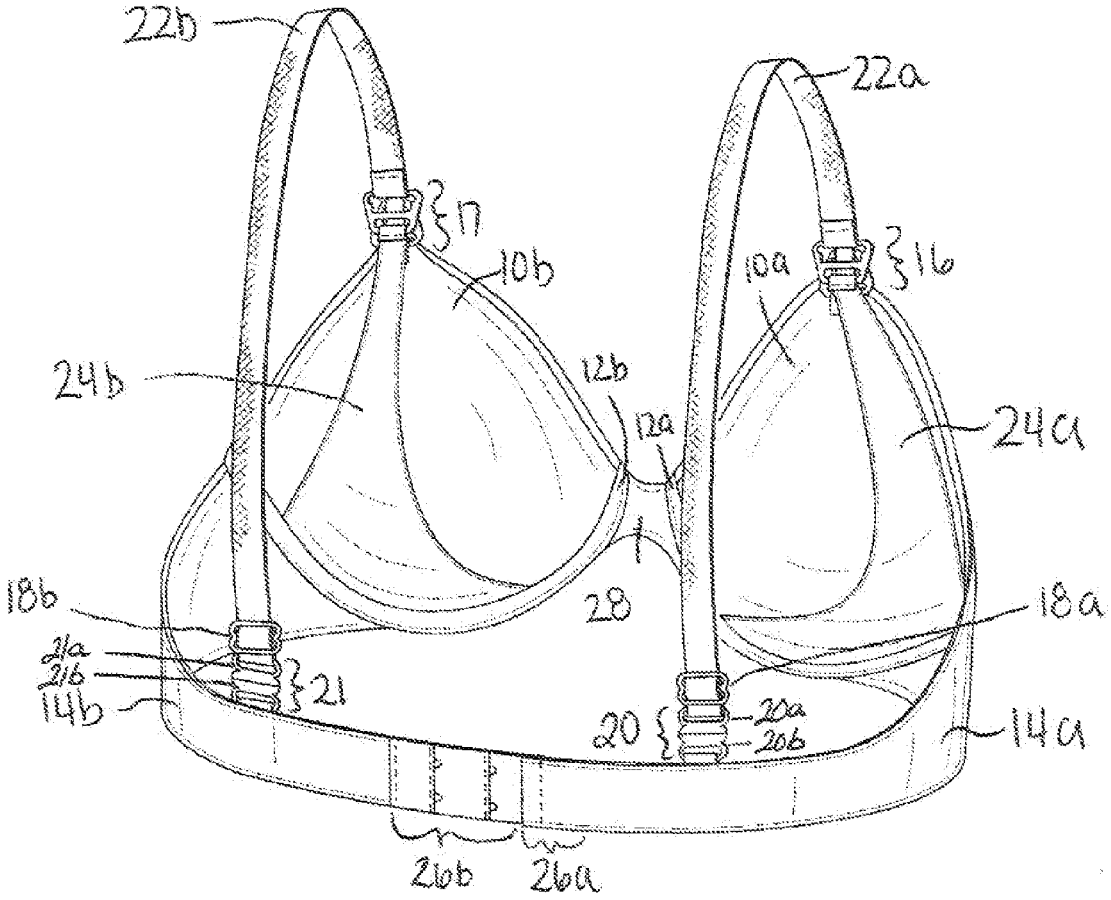
FIG. 4 is a rear perspective view of the first embodiment shown in FIG. 1.

Back band 14*a* can be detachably connected to back band 14*b*, or vice versa (not shown). As illustrated in FIG. 4, in one embodiment, back band 14*a* has hook panel 26*a*, and back band 14*b* has eye panel 26*b*. In order to close the bra, one or more eye elements positioned on eye panel 16*b* are inserted into one or more hook elements positioned on hook panel 26*a*. Hook panel 26*a* may include one or more columns of hook elements positioned spatially on back band 14*b* in order to adjust the band size of the bra for fit and comfort. Hook panel 26*a* may also have one or more rows of hook elements, depending on the width of back bands 14*a* and 14*b*. Although hook and eye closures are illustrated in this embodiment, any other suitable closures may be used to detachably connect back band 14*a* to back band 14*b*, such as, for example, snaps, clasps, clamps, clips, buttons, ties, or zippers, and can be made of plastic, metal, fabric, or any other suitable material.

In another embodiment of the invention, back bands 14*a* and 14*b* are constructed continuously and are not detachable (not shown). In this embodiment, front band 28 has a fastening element, e.g., hook panel 26*a* and eye panel 16*b*, as described previously, such that the bra may be opened and closed from the front instead of the back. Alternatively, both front band 28 and back bands 14*a* and 14*b* can have a fastening element, e.g., hook panel 26*a* and eye panel 26*b* (not shown), in order that the nursing bra can be opened and closed in either the front, the back; or both.

Cups 10*a* and 10*b*, front band 28, and back bands 14*a* and 14*b* may be made of one or more of any suitable materials, including, for example, knit fabric, cotton, silk, polyester, foam, elastic, microfiber, satin, Lycra™, nylon, spandex, or lace. Cups 10*a* and 10*b*, front band 28, and back bands 14*a* and 14*b* may be any color or pattern, to accommodate personal preferences, style, and other factors.

Shoulder straps 22*a* and 22*b* include strap adjustor elements 18*a* and 18*b*, respectively, for adjusting the length of shoulder straps 22*a* and 22*b* for fit and comfort. Strap adjustor elements 18*a* and 18*b* function by overlapping the shoulder strap onto itself in order to lengthen and shorten the strap. Strap adjustor elements 18*a* and 18*b* may be composed of plastic, metal, or any other suitable material.

Figure 2:
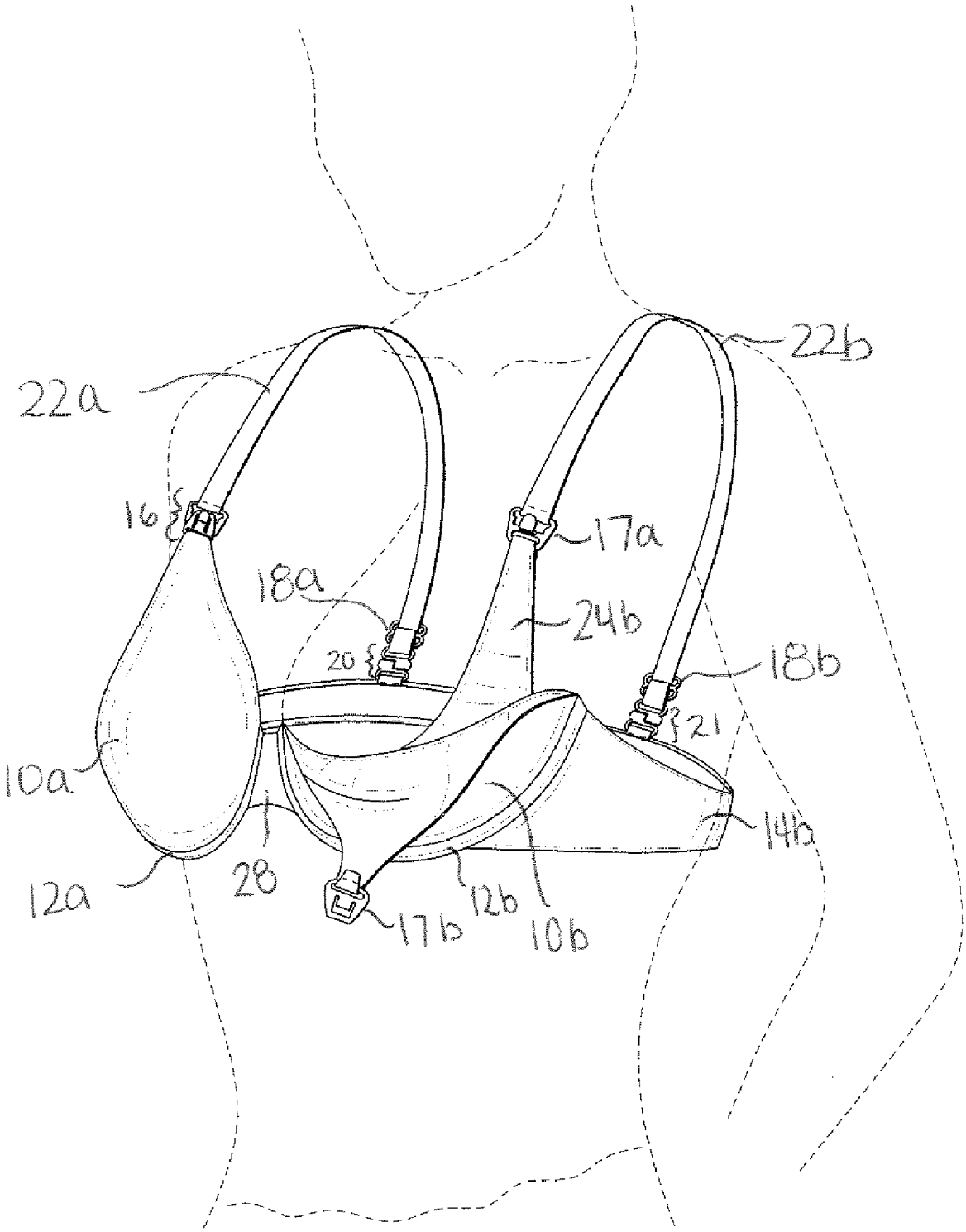
FIG. 2 is a front perspective view of the first embodiment of the nursing bra shown in FIG. 1 in an open position.

FIG. 2 shows a frontal view of a convertible nursing bra according to an embodiment the present invention. In this embodiment, fastener 17 has been separated into fasteners components 17*a* and 17*b*, and cup 10*b* has been folded down in order to facilitate nursing. Retaining strap 24*b*, interior to cup 10*b*, is exposed while nursing, and connects strap 22*b* to cup 10*b* so that strap 22*b* remains in position while nursing. Cup 10*b* may be reaffixed to strap 22*b* after nursing is complete by reattaching fastener components 17*a* and 17*b*. As shown in FIG. 4, retaining strap 24*a* is also present and is located interior to cup 10*a*. A mother may fold down either or both of cups 10*a* or 10*b* for nursing from either or both breasts, depending on the mother's comfort, ability, preference, or other factors.

Figure 5:
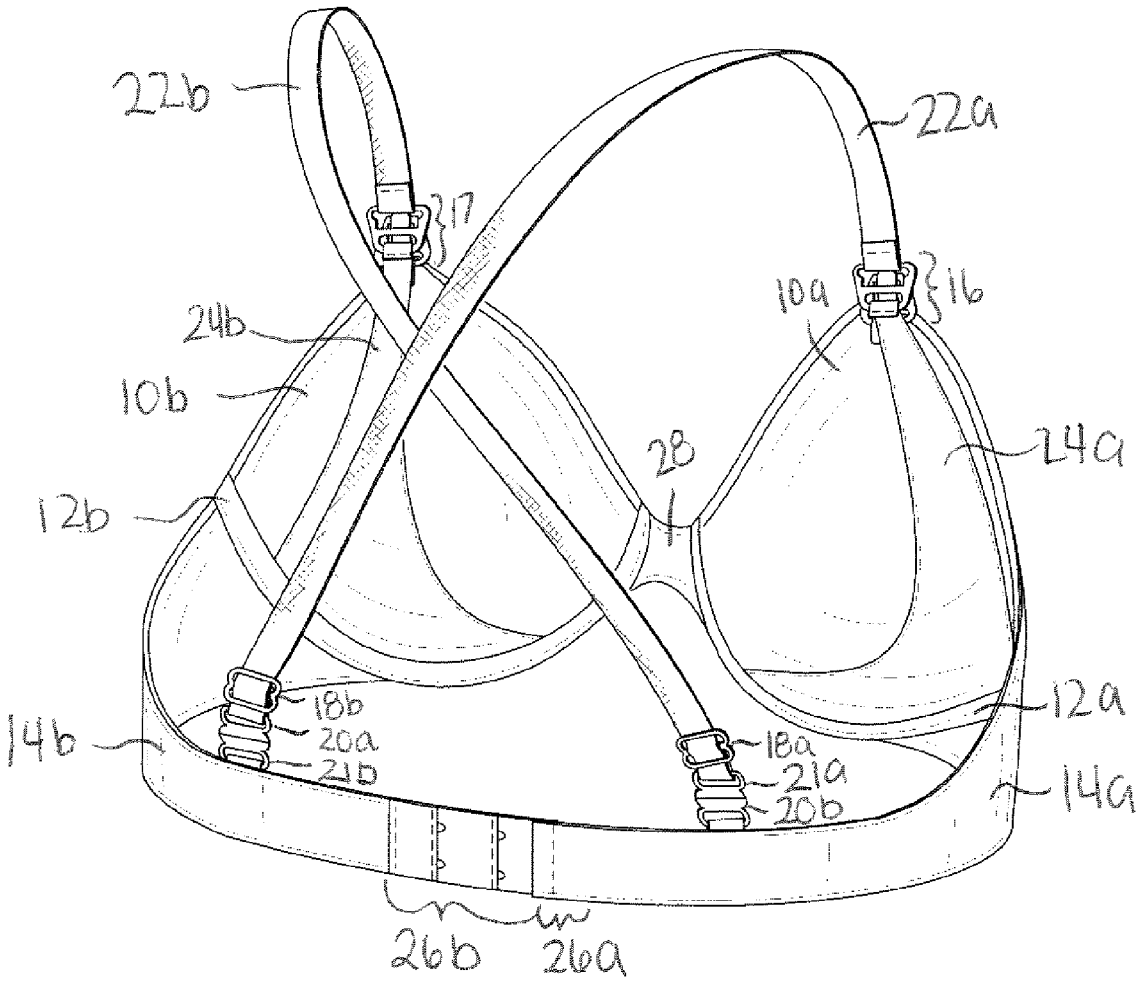
FIG. 5 is a rear perspective view of a second embodiment of the nursing bra.
Figure 6:
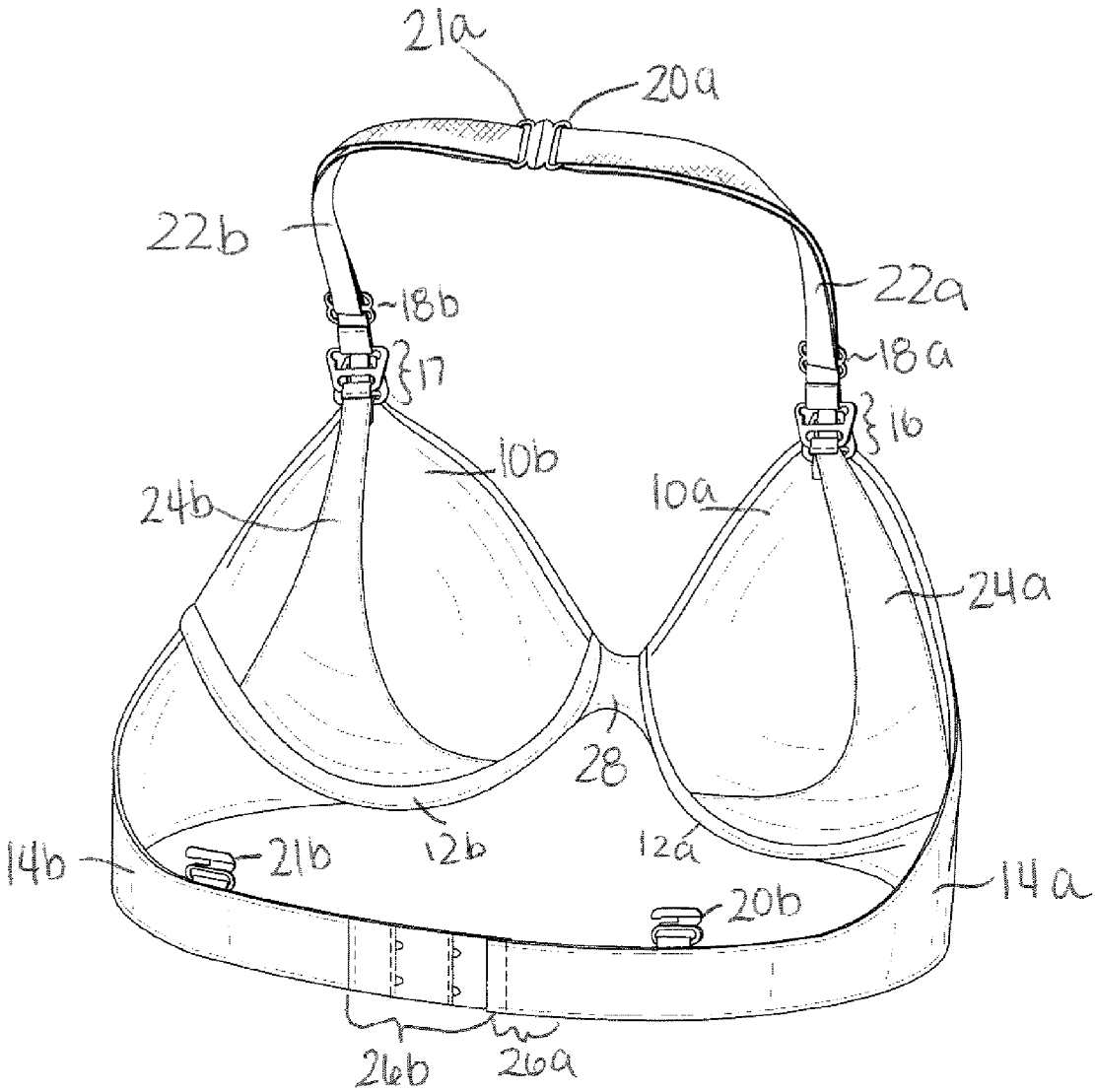
FIG. 6 is a rear perspective view of a third embodiment of the nursing bra.

Shoulder straps 22*a* and 22*b* are convertible and interchangeable among positions. To alter the configuration of the bra among various positions, back fastener 20 is separated into complementary fastener components 20*a* and 20*b*, and back fastener 21 is separated into complementary fastener components 21*a* and 21*b*. The complementary fastener components 20*a*, 20*b*, 21*a*, 21*b* are configured (i.e., shaped) in such a way as to engage one another to alter the configuration of the bra. In particular, each of the complementary fastener components 20*a*, 20*b*, 21*a*, 21*b* may include an interlocking tab and a recess portion. The interlocking tab of one complementary fastener component 20*a*, 20*b*, 21*a*, 21*b* slides and secures (i.e. snaps) into the recess portion of a second complementary fastener component 20*a*, 20*b*, 21*a*, 21*b*, creating an engagement therebetween. Complementary fastener component 20*a* can then be connected, for example, to complementary fastener component 21*b* (as shown in FIG. 5), complementary fastener component 21*a* (as shown in FIG. 6), or to complementary fastener component 20*b* to create back fastener 20 (as shown in FIG. 4). Complementary fastener component 21*a* can be connected, for example, to complementary fastener component 20*b* (as shown in FIG. 5), complementary fastener component 20*a* (as shown in FIG. 6), or to complementary fastener component 21*b* to create back fastener 21 (as shown in FIG. 4

FIG. 5 illustrates a convertible nursing bra of the present invention in a racerback configuration. This configuration is created by attaching back complementary fastener 20*a* to back complementary fastener 21*b*, and back complementary fastener 21*a* to back complementary fastener 20*b*. This configuration allows for a nursing mother to wear a racerback style shirt or top while keeping shoulder straps 22*a* and 22*b* fully covered for style, modesty, propriety, and other purposes.

Moreover, other implementations of the invention will be apparent to those skilled in the art from consideration of the specification and practice of the invention disclosed herein. Various aspects and/or components of the described embodiments may be used singly or in any combination. It is intended that the specification and examples be considered as exemplary only, with a true scope and spirit of the invention being indicated by the following claims.

What is claimed is:

1. A nursing bra comprising:

first and second bra cups;

a first back band having a first end and a second end, the first end of the back band connected to the first bra cup, wherein a first complementary fastener component is secured to the first back band;

a second back band having a first end and second end, the first end of the second back band connected to the second bra cup, wherein the second end of the first back band is configured to connect to the second end of the second back band, and wherein a second complementary fastener component is secured to the second back band;

a first shoulder strap having a first end and a second end, wherein the first end is configured to be detachably connected to the first bra cup, and wherein a third complementary fastener component is secured to the second end of the first shoulder strap;

a second shoulder strap having a first end and a second end, wherein the first end is configured to be detachably connected to the second bra cup, and wherein a fourth complementary fastener component is secured to the second end of the second shoulder strap;

a first retaining strap having a first end connected to the first end of the first shoulder strap and a second end connected to a lower portion of the first bra cup; and a second retaining strap having a first end connected to the first end of the second shoulder strap and a second end connected to a lower portion of the second bra cup;

wherein the third and the fourth complementary fastener components are configured to engage each of the first and second complementary fastener components and each other to configure the nursing bra in each of three positions: (i) a first position wherein the second end of the first shoulder strap is connected to the first back band via engagement of the third complementary fastener component and the first complementary fastener component and wherein the second end of the second shoulder strap is connected to the second back band via engagement of the fourth complementary fastener component and the second complementary fastener component; (ii) a second position wherein the second end of the first shoulder strap is connected to the second back band via engagement of the third complementary fastener component and the second complementary fastener component and wherein the second end of the second shoulder strap is connected to the first back band via engagement of the fourth complementary fastener component and the first complementary fastener component; and (iii) a third position wherein the second end of the first shoulder strap is connected to the second end of the second shoulder strap via engagement of the third complementary fastener component and the fourth complementary fastener component.

2. The nursing bra of claim 1, wherein at least one of the first and second bra cups is detachable from at least one of the first and second shoulder straps in order to facilitate nursing.

3. The nursing bra of claim 1, wherein the first and second bra cups are connected via a connection element.

4. The nursing bra of claim 3, wherein the connection element comprises at least one fastening element to facilitate opening and closing of the nursing bra.

5. The nursing bra of claim 1, wherein the first and second bra cups each include an underwire element within the lower portion of each of the first and second bra cups.

6. The nursing bra of claim 5, wherein each of the underwire elements has a first end positioned on an inner portion of the first and second bra cups, and a second end positioned on a distal portion of the first and second bra cups.

7. The nursing bra of claim 1, wherein each of the second end of the first back band is configured to connect to the second end of the second back band via fastening elements.

8. The nursing bra of claim 1, wherein the first shoulder strap is configured to be detachably connected to the first bra cup and the second shoulder strap is configured to be detachably connected to the second bra cup via one or more fastening elements.

9. The nursing bra of claim 8, wherein the first shoulder strap is configured to be detachably connected to the first back band and the second shoulder strap is configured to be detachably connected to the second back band via one or more fastening elements.

10. The nursing bra of claim 1, wherein the first and second shoulder straps are adjustable.

11. The nursing bra of claim 1, wherein the first and second bra cups are configured to accommodate a nursing pad.

12. The nursing bra of claim 1, further comprising one or more fastening elements positioned at the second end of at least one of the first back band and second back band.

* * * * *

UNITED STATES PATENT AND TRADEMARK OFFICE

CERTIFICATE OF CORRECTION

PATENT NO. : 8,075,369 B2
APPLICATION NO. : 12/574371
DATED : December 13, 2011
INVENTOR(S) : Lisa A. Hendrickson It is certified that error appears in the above-identified patent and that said Letters Patent is hereby corrected as shown below:

In Column 4 at line 24

Please insert the following paragraph [026]:

--FIG. 6 illustrates a convertible nursing bra of the present invention in a halter configuration. This configuration is created by attaching complementary fastener 20a to complementary fastener 21a. This configuration allows for a nursing mother to wear a halter top style shirt while keeping shoulder straps 22a and 22b fully covered for style, modesty, propriety, and other purposes.--

Signed and Sealed this
Tenth Day of July, 2012

David J. Kappos

David J. Kappos
*Director of the United States Patent and Trademark Office*